United States Patent [19]

Heier et al.

[11] Patent Number: 4,556,499

[45] Date of Patent: Dec. 3, 1985

[54] PROCESS FOR IMPROVING THE FLOW PROPERTIES OF MINERAL OILS

[75] Inventors: Karl H. Heier, Frankfurt am Main; Roland Böhm, Kelkheim; John V. Hobes, Dinslaken, all of Fed. Rep. of Germany

[73] Assignee: Hoechst Aktiengesellschaft, Fed. Rep. of Germany

[21] Appl. No.: 559,836

[22] Filed: Dec. 8, 1983

Related U.S. Application Data

[63] Continuation of Ser. No. 360,164, Mar. 22, 1982, abandoned.

[30] Foreign Application Priority Data

Mar. 28, 1981 [DE] Fed. Rep. of Germany ..... 3112456

[51] Int. Cl.[4] ..... C16M 1/32

[52] U.S. Cl. ..... 252/51.5 A; 44/62; 44/71

[58] Field of Search ..... 252/51.5 A; 44/62, 71

[56] References Cited

U.S. PATENT DOCUMENTS

| | | | |
|---|---|---|---|
| 2,800,452 | 7/1957 | Bondi et al. | 44/62 X |
| 2,958,590 | 11/1960 | Siegel | 44/71 X |
| 3,015,546 | 1/1962 | Michaels et al. | 252/51.5 A X |
| 3,037,850 | 6/1962 | Wythe et al. | 44/62 |
| 3,222,282 | 12/1965 | Berkowitz et al. | 252/51.5 A |
| 3,658,493 | 4/1972 | Hollyday, Jr. | 44/71 X |
| 3,966,428 | 6/1976 | Rossi | 44/62 |
| 4,211,534 | 7/1980 | Feldman | 44/71 X |
| 4,261,703 | 4/1981 | Tack et al. | 44/62 |

FOREIGN PATENT DOCUMENTS

| | | | |
|---|---|---|---|
| 822632 | 10/1959 | United Kingdom | 252/51.5 A |
| 917923 | 2/1963 | United Kingdom | 252/51.5 A |
| 1244506 | 9/1971 | United Kingdom | 44/62 |

OTHER PUBLICATIONS

Guthrie, V. B., Petroleum Products Handbook, 1960, 2-32.

Smalheer, C. V. et al., "Lubricant Additives", 1967, Lezius-Hiles Co., pp. 7-9.

*Primary Examiner*—William R. Dixon, Jr.
*Assistant Examiner*—Cynthia A. Prezlock
*Attorney, Agent, or Firm*—Connolly and Hutz

[57] ABSTRACT

A process for improving the flow properties of mineral oils by adding a copolymer consisting of from 66 to 99.9 weight % of ethylene and of from 0.1 to 40 weight % of vinylic acid amide and optionally of further comonomers.

6 Claims, No Drawings

PROCESS FOR IMPROVING THE FLOW PROPERTIES OF MINERAL OILS

This application is a continuation of U.S. Ser. No. 360,164 filed Mar. 22, 1982, now abandoned.

It is known that paraffin contained in mineral oils, for example crude oil, diesel oil or oil fuel, separates therefrom by crystallization at low temperatues. This leads to disturbing deposits in the plants in the oil field or to an obstruction of preliminary filters of diesel engines and furnaces, which, during winter, may result in an interruption of operation of these plants. To avoid this, there are added to the mineral oil ethylene/vinyl acetate copolymer waxes, ethylene/acrylic esters copolymers or polyisobutylene. These products have, however, a low solubility only and are therefore unsatisfactory as regards their efficiency. It was therefore a task to provide more efficient additives which should be capable of preventing a crystallization of paraffin and of improving the flow properties of mineral oils.

It has now been found that the flow properties of mineral oils can be improved by adding thereto a copolymer based on vinylic acid amide and on ethylene.

These copolymers are obtained by high pressure polymerization in the presence of free radical-forming compounds under a pressure of from about 1,000 to 8,000, preferably 1,500 to 2,500 bars, at a temperature of from 100 to 350, preferably 200° to 350° C., upon an average dwelling time of at most 150 seconds. Ethylene used for the polymerization is employed in a purity of at least 99.9%, which is usual for polymerization reactions. Examples of suitable vinylic acid amides are vinyl formamide, vinyl acetamide, vinyl-N-methyl acetamide and vinyl propionamide. The proportion of the vinylic acid amide in the copolymer amounts to 0.1–40 weight % and the proportion of ethylene accordingly to 99.9–60 weight %.

Vinyl-N-methyl acetamide is used preferably in an amount of from 0.5 to 30 weight % in the copolymerization with ethylene.

The copolymer may further contain, in an amount up to 40 weight %, monomers that are copolymerizable with with ethylene, in particular acrylic esters and vinyl esters such as, for example, methyl acrylate, ethyl acrylate, butyl acrylate, 2-ethyl-hexyl acrylate or acetic acid vinyl ester. Further suitable monomers are, for example, $C_3$ to $C_8$ alkenes, vinyl and alkenyl ethers, vinyl and alkenyl alcohols, N-vinyl compounds and N-alkenyl compounds such as N-vinyl pyrrolidone, N-vinyl carbazole, N-vinyl caprolactam, acrylamides and methacrylamides, acrylonitriles and methacrylonitriles, alkenyl halides such as vinyl fluoride and vinylidene fluoride, vinyl ketones and alkenyl ketones, vinyl sulfones and sulfonates and alkenyl sulfones and sulfonates and styrene. Carbon monoxide and sulfur dioxide may further be incorporated by polymerization, in addition to ethylenically unsaturated compounds.

Polymerization is effected under the conditions specified above in the presence of catalytic amounts of free-radical forming initiators using for example from 2 to 250 mol ppm of oxygen, referred to ethylene. Further suitable initiators, in addition to oxygen, are peroxides such as tert.-butyl perbenzoate, dilauroyl peroxide, ditert. butyl peroxide or azobutyric acid dinitrile used in an amount from 2 to 200 mol ppm, referred to ethylene. The molecular weight is adjusted at the desired value by adding moderators in an amount from 2 to 25 volume %, depending on the desired value. Low-molecular copolymers having a molecular weight from 500 to 10,000, determined according to K. Rast, Ber. 550, 1922, pages 1051 and 3727, are aimed at. Examples of suitable moderators are aliphatic alcohols and carbonyl compounds, saturated and unsaturated hydrocarbons, chlorinated hydrocarbons and hydrogen.

The copolymers obtained from ethylene and vinylic acid amide bring about an improvement of the flow properties of mineral oils, for example in middle distillates of the crude oil distillation and in the crude oil itself, as they act on the crystal growth of the paraffin precipitating in the cold in a manner such that the paraffin crystals remain small and do not agglomerate so that they are able to pass the filters. These copolymers are added generally to the mineral oil in the form of about 40 to 45% solutions in an aromatic hydrocarbon. The quantity of copolymer, referred to the mineral oil, should amount to 0.001 to 2, preferably 0.005 to 0.5, weight %. These copolymers may naturally be added to the mineral oil alone or in conjunction with other additives, for example with pour-point depressors or dewaxing auxiliaries, corrosion inhibitors, antioxidants or sludge inhibitors. The copolymers based on N-ethylene and vinylic acid amide are moreover suitable for use as adhesives, as coating composition, for the manufacture of stretch, skin and shrink films, for injection molding and for tube and wire coating.

The following examples serve to illustrate the invention:

EXAMPLE 1

A reaction mixture consisting of 98.7 weight % of ethylene and of 1.3 weight % of vinyl-N-methyl acetamide (VIMA) was compressed until a pressure of 2,000 bar was reached. Polymerization was initiated by using 30 ppm of butyl peroctoate (in the form of a gasoline solution). The reaction temperature was 218° C. The resulting copolymer had a melt index of about 2.7 g/10 minutes and a density of about 0.927 g/cm$^3$. It contained 0.9 weight % of VIMA bound in polymeric manner.

The mechanical data of the copolymer were as follows:

tensile stress at yield: 14 N/mm$^2$
ultimate tensile strength: 21 N/mm$^2$
impact tensile strength: 1,500 mJ/mm$^2$.

EXAMPLE 2

A reaction mixture consisting of 94.3 weight % of ethylene and of 5.7 weight % of VIMA was compressed until a pressure of 2,100 bar was reached. Polymerization was initiated by using 35 ppm of tert-butyl peroctoate. The reaction temperature was 210° C. 5.7 weight % of VIMA were incorporated by polymerization. The resulting copolymer had a melt index of about 1.8 g/10 minutes and a density of 0.929 g/cm$^3$.

The mechanical data of the copolymer were as follows:

tensile stress at yield: 11 N/mm$^2$
ultimate tensile strength: 21 N/mm$^2$
impact tensile strength: 2,400 mJ/mm$^2$.

EXAMPLE 3

A reaction mixture consisting of 88.8 weight % of ethylene and of 11.2 weight % of VIMA was compressed until a pressure of 2,100 bar was reached and subjected to polymerization, at a temperature of 210°

C., using 40 ppm of butyl peroctoate as the initiator. The copolymer obtained contained 10.3 weight % of VIMA, had a melt index of 4.3 g/10 minutes and a density of 0.931 g/cm$^3$.

The mechanical data of the copolymer were as follows:

tensile stress at yield: 11 N/mm$^2$
ultimate tensile strength: 22 N/mm$^2$
impact tensile strength: 210 mJ/mm$^2$.

The tensile stress at yield and the ultimate tensile strength were determined according to the German industrial standard DIN 53 455 and the impact tensile strength was determined according to DIN 53 448.

EXAMPLE 4

300 ppm of a 45% solution in xylene of a copolymer consisting of 95 weight % of ethylene and of 5 weight % of vinyl methyl acetamide and having a viscosity of 600 mPas were added to a middle distillate which began to boil at 178° C. and ceased to boil at 376° C., a 5% portion of which boiling at 201° C. and a 95% portion boiling at 359° C. and which had a cloud point of −1° C. The middle distillate treated in the above manner had a CFPP value of −11° C.

EXAMPLE 5

300 ppm of a 45% solution in xylene of a copolymer consisting of 70 weight % of ethylene, of 25 weight % of tert.-butyl acrylate and of 5 weight % of vinyl methyl acetamide and having a viscosity of 600 mPas were added to a middle distillate as specified in Example 4. The middle distillate thus treated had a CFPP value of −13° C.

EXAMPLE 6

300 ppm of a 45% solution in xylene of a copolymer consisting of 90 weight % of ethylene and of 10 weight % of vinyl methyl acetamide and having a viscosity of 600 mPas were added to a middle distillate rich in paraffin, which began to boil at 172° C. and ceased to boil at 384° C., a 5% portion of which boiling at 190° C. and 95% portion boiling at 359° C., and which had a cloud point of +8° C. The middle distillate thus treated had a CFPP value of −6° C.

EXAMPLE 7

300 ppm of a 45% solution in xylene of a copolymer consisting of 86.8 weight % of ethylene, of 6.6 weight % of vinyl acetate and of 6.6 weight % of vinyl methyl acetamide and having a viscosity of 600 Mpas were added to a middle distillate as specified in Example 6. The middle distillate thus treated had a CFPP value of −6° C.

EXAMPLE 8

300 ppm of a 45% solution in xylene of a copolymer consistng of 68 weight % of ethylene and of 32 weight % of vinyl acetate and having a viscosity of 900 mPas were added to a middle distillate which began to boil at 167° C., a 5% portion of which boiling at 175° C. and a 95% portion boiling at 372° C., and which had a cloud point of +5° C. The middle distillate thus treated had a CFPP value of −8° C.

When adding to this middle distillate an equal quantity of a copolymer consisting of 75 weight % of ethylene and of 25 weight % of vinyl methyl acetamide and having a viscosity of 500 mPas there was obtained a CFPP value of −11° C.

When adding to the above middle distillate an equal quantity of a mixture of the above-specified copolymers in a ratio of 1:1 there was obtained a CFPP value of −16° C.

COMPARATIVE EXAMPLE A 300 ppm of a 45% solution in xylene of a copolymer consisting of 70 weight % of ethylene and of 30 weight % of tert.-butyl acrylate and having a viscosity of 600 mPas were added to a middle distillate as specified in Example 4. The middle distillate thus treated had a CFPP value of −7° C.

COMPARATIVE EXAMPLE B 300 ppm of a 45% solution in xylene of a copolymer consisting of 85 weight % of ethylene and of 15 weight % of vinyl acetate and having a viscosity of 1,500 mPas were added to a middle distillate as specified in Example 6. The middle distillate thus treated had a CFPP value of +1° C.

In the above examples the viscosity was measured at 140° C. in a rotating viscosimeter (Rotovisko). By "CFPP value" there is to be understood the plugging point of the filter at low temperatures, this point indicating the temperature at which the oil stops flowing in the test apparatus. This test is described in "Journal of the Institute of Petroleum", vol. 52, No. 510, June 1966, pages 173–185 and in the German industrial standard DIN 51 428.

The copolymer to be used according to the invention not only provokes a substantial improvement of the flow properties of mineral oils and mineral oil products, when used alone, on the contrary, it has a pronounced synergistic effect when used in conjunction with other copolymers as pour-point depressors. This can be clearly seen in Example 8, where the effect measured upon the use of a mixture of a copolymer based on ethylene and vinyl acetate and of a copolymer based on ethylene and vinyl methyl acetamide was distinctly better than that reached upon the use of an equal quantity of only one of both copolymers.

What is claimed is:

1. A process for improving the flow properties of middle distillates or lubricating mineral oils, which comprises adding to the middle distillates or lubricating mineral oils from 0.001 to 2 percent by weight of a copolymer which has been polymerized from a monomer mixture consisting essentially of ethylene and vinyl formamide, vinyl acetamide, vinyl-N-methyl acetamide, or vinyl propionamide.

2. The process of claim 1, which comprises adding to the middle distillate or lubricating oil a copolymer consisting essentially of from 60 to 99.9 weight % of ethylene and of from 0.1 to 40 weight % of vinyl formamide, vinyl acetamide, vinyl-N-methyl acetamide, or vinyl propionamide.

3. A process for improving the flow properties of middle distillates or mineral lubricating oils which comprises adding to the middle distillate or mineral lubricating oil from 0.001 to 2 percent by weight of a copolymer which has been polymerized from a monomer mixture consisting essentially of ethylene and vinyl formamide, vinyl acetamide, vinyl-N-methyl acetamide, or vinyl propionamide, and at least one of the following monomers copolymerizable with ethylene: an acrylic ester, a vinyl ester, a $C_3$ to $C_8$ alkene, a vinyl ether, a $C_3$ to $C_8$ alkenyl ether, vinyl alcohol, a $C_3$–$C_8$ alkenyl alcohol, an N-vinyl compound, an N-$C_3$–$C_8$-alkenyl compound, acrylamide, methacrylamide, acrylonitrile, methacrylonitrile, a $C_3$–$C_8$ alkenyl halide, vinyl fluoride, vinylidene fluoride, a vinyl ketone, a $C_3$ to $C_8$ alkenyl ketone, a vinyl sulfone, a vinyl sulfonate, a $C_3$–$C_8$ alkenyl sulfone, a $C_3$–$C_8$ alkenyl sulfonate, or styrene.

4. The process of claim 1, which comprises adding to the middle distillate or mineral lubricating oil a copolymer which has been polymerized from a monomer mixture consisting essentially of ethylene and vinyl formamide, vinyl acetamide, vinyl-N-methyl acetamide, or vinyl propionamide, and which consists additionally of essentially up to 40 weight percent of a further monomer which is a said monomer copolymerizable with ethylene.

5. The process of claim 1 which comprises improving the flow properties of middle distillates or mineral lubricating oils with an approximately 1:1 combination of the said copolymer and an ethylene/vinyl acetate copolymer.

6. A process according to claim 1 wherein the middle distillate or mineral lubricating oil is diesel oil or fuel oil obtained from crude oil and contains paraffins which can separate therefrom by crystallization in the absence of said copolymer.

* * * * *